US006564473B2

(12) United States Patent
Aydore

(10) Patent No.: US 6,564,473 B2
(45) Date of Patent: May 20, 2003

(54) HIGH EFFICIENCY HEAT TRANSFER USING ASYMMETRIC IMPINGING JET

(75) Inventor: Savas Aydore, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/037,121

(22) Filed: Oct. 22, 2001

(65) Prior Publication Data

US 2003/0074805 A1 Apr. 24, 2003

(51) Int. Cl.[7] ..... F26B 21/00

(52) U.S. Cl. ..... 34/504; 34/631; 34/638; 34/639; 34/640; 34/641; 34/432; 34/566

(58) Field of Search ..... 239/589; 34/309, 34/311, 631, 504, 72, 73, 84, 638, 639, 640, 641, 430, 431, 432, 433, 434, 435, 508, 509, 510, 486, 487, 566, 582, 585, 419, 422, 427

(56) References Cited

U.S. PATENT DOCUMENTS

| | | | | |
|---|---|---|---|---|
| 3,739,490 A | | 6/1973 | Comstock | |
| 3,763,571 A | * | 10/1973 | Vits | 34/57 A |
| 3,771,239 A | | 11/1973 | Minoda et al. | |
| 3,895,449 A | | 7/1975 | Chance et al. | |
| 3,936,953 A | | 2/1976 | Chance et al. | |
| 4,033,049 A | | 7/1977 | Schiel et al. | |
| 4,074,841 A | * | 2/1978 | Kramer et al. | 226/97 |
| 4,197,973 A | | 4/1980 | Daane | |
| 4,274,210 A | | 6/1981 | Stengard | |
| 4,361,466 A | | 11/1982 | Wong et al. | |
| 4,809,446 A | | 3/1989 | Langer | |
| 4,932,140 A | * | 6/1990 | Lepisto | 34/156 |
| 4,953,297 A | | 9/1990 | Eskelinen et al. | |
| 5,014,447 A | | 5/1991 | Hagen | |
| 5,105,562 A | | 4/1992 | Hella et al. | |
| 5,254,166 A | * | 10/1993 | Tu | 118/63 |

(List continued on next page.)

FOREIGN PATENT DOCUMENTS

| | | |
|---|---|---|
| DE | 2458001 A1 | 6/1975 |
| DE | 2458002 A1 | 6/1976 |
| EP | 0 561 256 B1 | 7/2001 |
| GB | 940881 | 11/1963 |
| GB | 2153508 A | 8/1985 |
| WO | WO 99/32714 | 7/1999 |
| WO | WO 01/02643 | 1/2001 |

OTHER PUBLICATIONS

Gardon, Robert and Akfirat, J. Cahit, "The Role Of Turbulence in Determining The Heat–Transfer Characteristics Of Impinging Jets", Int. J. Heat Mass Transfer, 1965, pp. 1261–1272, vol. 8, Pergamon Press, Great Britain.

Gardon, Robert and Akfirat, J. Cahit, "Heat Transfer Characteristics of Impinging Two–Dimensional Air Jets", Journal of Heat Transfer, Feb. 1966, pp. 101–108.

Gardon, Robert and Cobonpue, John, "Heat Transfer Between a Flat Plate and Jets of Air Impinging on It", International Heat Transfer Conference, University of Colorado, Part II, Sep. 1961, pp. 454–460.

(List continued on next page.)

*Primary Examiner*—Ira S. Lazarus
*Assistant Examiner*—K. B. Rinehart
(74) *Attorney, Agent, or Firm*—David M. Weirich; Ken K. Patel; Steven W. Miller

(57) ABSTRACT

A method and apparatus for impingement of fluid onto a moving surface. The apparatus includes an asymmetric slot nozzle having an opening formed between an upstream wall and a downstream wall. The nozzle is disposed generally adjacent the surface onto which the fluid is to be impinged forming an impingement distance between each of the walls of the nozzle and the surface. The impingement distance of the upstream wall is greater than the impingement distance of the downstream wall such that at least a portion of the fluid is delivered through the nozzle in a direction that is counter to the machine direction.

20 Claims, 4 Drawing Sheets

U.S. PATENT DOCUMENTS

| | | | | | |
|---|---|---|---|---|---|
| 5,299,362 | A | * | 4/1994 | Baldinger | 34/4 |
| 5,495,678 | A | | 3/1996 | Ilmarinen et al. | |
| 5,548,907 | A | | 8/1996 | Gourdine | |
| 5,577,294 | A | * | 11/1996 | Pollock | 15/345 |
| 5,653,041 | A | | 8/1997 | Ilmarinen et al. | |
| 5,829,166 | A | * | 11/1998 | Klas | 34/641 |
| 5,865,955 | A | | 2/1999 | Iivespääet al. | |
| 6,003,245 | A | | 12/1999 | Lipponen et al. | |
| 6,018,886 | A | | 2/2000 | Bell et al. | |
| 6,085,437 | A | | 7/2000 | Stipp | |
| 6,101,735 | A | | 8/2000 | Kuhasalo et al. | |
| 6,128,833 | A | | 10/2000 | Juppi et al. | |

OTHER PUBLICATIONS

Gutmark, E. and Wolfshtein, M., "The plane turbulent impinging jet", J. Fluid Mech., 1978, pp. 737–756, vol. 88, Part 4, Great Britain.

Hartnett, James P. and Irvine, Thomas F., Jr., "Heat and Mass Transfer between Impinging Gas Jets and Solid Surfaces", Advances in Heat Transfer, 1977, pp. 1–60, vol. 13, Academic Press, New York.

Huang, G. C., "Investigations of Heat–Transfer Coefficients for Air Flow Through Round Jets Impinging Normal to a Heat–Transfer Surface", Journal of Heat Transfer, Aug. 1963, pp. 237–245.

Page, R. H. and Seyed–Yagoobi, J., "A new concept for air or vapor impingement drying", Tappi Journal, Sep. 1990, pp. 229–234.

Perry, K. P., "Heat Transfer by Convection from a Hot Gas Jet to a Plane Surface", The Institution of Mechanical Engineers Proceedings 1954, 1954, pp. 775–784, vol. 168, The Institution of Mechanical Engineers, Great Britain.

Sparrow, E. M. and Wong, T. C., "Impingement Transfer Coefficients Due to Initially Laminar Slot Jets", Int. J. Heat Mass Transfer, 1975, pp. 597–605, vol. 18, Pergamon Press, Great Britain.

Tabakoff W. and Clevenger, W., "Gas Turbine Blade Heat Transfer Augmentation by Impringement of Air jets Having Various Configurations," Journal of Engineering for Power, Jan. 1972, pp. 51–60.

Thiele, E. W.; Seyed–Yagoobi, J.; Page R.H.; and Castillo–Garcia, Sr. H., Enhancement Of Drying Rate, Moisture Profiling And Sheet Stability On An Existing Paper Machine With RJR Blow Boxes, TAPPI Proceedings 1995 Papermakers Conference, 1995, pp. 223–228.

* cited by examiner

HIGH EFFICIENCY HEAT TRANSFER USING ASYMMETRIC IMPINGING JET

FIELD OF INVENTION

The present invention is related to a method and apparatus for transferring heat between a fluid and a material onto which the fluid is impinged. More specifically, the present invention is related to an impinging jet nozzle that can improve the efficiency of heat transfer between the fluid passing through the nozzle and the material onto which the fluid is impinged.

BACKGROUND OF THE INVENTION

Impingement of fluids, such as air or other gasses or liquids, onto a surface has been recognized and used for years in many situations, especially manufacturing, as a method for providing and/or alter the properties of products such as webs. In particular, impingement has been used during the manufacture of fibrous structures, such as paper webs. Typically, during the manufacture of paper, large amounts of water must be removed from the web that is created before it can be converted into an end product or used by the consumer. Some of the most commonly used papermaking techniques form an initial paper web from an aqueous dispersion of fibers containing more than 99% water and less than 1% papermaking fibers. Generally, almost 99% of this water is removed mechanically, yielding a fiber-consistency of about 20%. Then, pressing and/or thermal operations, and/or through-air-drying, or any combination thereof, typically remove some of the remaining water, increasing the fiber-consistency of the web to about 60%. In the final drying operation (typically using a drying cylinder and impinging jets) the web is dried such that the fiber-consistency of the web is about 95%.

Because such a great amount of water needs to be removed, water removal is one of the most energy-intensive operations in industrial papermaking processes. Further, within the water removal operations, thermal energy is one of the most costly and inefficiently used resources. Therefore, more efficient methods of water removal, and especially more efficient thermal operations, may provide significant benefits for the papermaking industry, such as increased machine capacity and reduced operational costs.

As can be seen in U.S. Pat. Nos. 3,577,651; 3,739,490; 3,771,239; 3,895,449; 3,936,953 and 4,274,210, the need to improve efficiency of heat transfer has been generally identified in the prior art and many attempts have been made to solve the problem. However, there is still a need for more efficient, less complex systems that perform effectively at very high rates of speed, especially when the end product, like paper, is disposable.

Accordingly, it would be desirable to provide a method and/or apparatus for more efficiently transferring heat from a fluid to a moving material. Further, it would be desirable to provide an improved nozzle to be used in an impingement operation. Even further, it would be desirable to provide an asymmetric nozzle through which air or gas may be impinged onto a surface to more efficiently transfer heat from the air or gas to the surface upon which the air or gas is impinged. It would also be desirable to provide an improved process and apparatus for drying webs, such as paper webs.

SUMMARY OF THE INVENTION

The present invention provides an efficient method and apparatus for exchanging heat between a fluid and a material onto which the fluid is impinged. One embodiment of the apparatus includes: a support element designed to receive a material thereon and to carry the material in a machine direction, the material having a surface oriented away from the support element; at least one fluid supply designed to produce and discharge a fluid; at least one nozzle having an open area formed by an upstream wall and a downstream wall relative to the machine direction, the nozzle connected to the fluid supply and disposed generally adjacent to the support element and spaced apart therefrom so as to form an impingement distance between each wall of the nozzle and a plane generally corresponding to the surface of the material, wherein the impingement distance between the upstream wall and the plane is greater than the impingement distance between the downstream wall and the plane such that at least a portion of the fluid is delivered through the nozzle to a predetermined portion of the material carried by the support element in a direction that is counter to the machine direction; an upstream collection device which is disposed upstream relative to the nozzle; and a downstream collection device which is disposed downstream relative to the nozzle.

One embodiment of the method of the present invention includes the steps of: providing at least one nozzle having an opening formed by an upstream wall and a downstream wall relative to the machine direction, the nozzle connected to a fluid supply and disposed generally adjacent to the support element and spaced apart therefrom so as to form an impingement distance between each wall of the nozzle and a plane generally corresponding to a surface of a material onto which the fluid is to be impinged, wherein the impingement distance between the upstream wall and the plane is greater than the impingement distance between the downstream wall and the plane; providing a material adjacent the opening in the nozzle, the material moving in the machine direction; and supplying a fluid from the fluid supply through the nozzle onto the material such that at least a portion of the fluid is delivered in a direction that is counter to the machine direction.

DETAILED DESCRIPTION OF THE INVENTION

The present invention is directed to an improved process and apparatus for transferring heat from a stream of fluid (such as air, other gasses and liquids) to an adjacent material, such as a web, by impingement of the stream onto the material. Although impingement is commonly used in drying operations, such as those used during the papermaking process, it can also be used for heating, cooling or dewatering other materials as well as for transferring mass and momentum to objects. Thus, for example, the apparatus and process of the present invention may be used to dry materials such as boards, to cool objects such as jet engine fan blades or computer chips, to cook foods, to cure surfaces, to heat treat materials, to move or lift objects, to coat objects and/or to clean objects or surfaces.

As will be described in more detail below, the process and apparatus of the present invention employ a unique asymmetrical slot nozzle to direct the impingement flow of fluid onto the adjacent material. The configuration of the nozzle provides an unexpected increase in the heat transferred from the fluid stream to the material onto which the fluid is impinged, especially when the fluid is impinged on a surface that is moving greater than about 3000 feet per minute (about 15.2 meters per second). The combination of the unique nozzle with certain predetermined exhaust duct configurations to remove the impinged fluid can further increase the effectiveness of the apparatus and method or of the present invention. Accordingly, the apparatus and process of the present invention can outperform the prior art impingement systems and achieve previously unattainable performance related to reduced energy consumption, higher line speeds, lower drying temperatures, higher cooling temperatures, etc.

Although as noted above impingement systems can be used for a wide variety of purposes, the present invention will be described herein in terms of an exemplary system used for drying paper webs. It should be understood that modifications to the exemplary systems described herein could be made so as to conform any portion or the entire system to a particular need without departing from the intended scope of the present invention.

Figure 1:
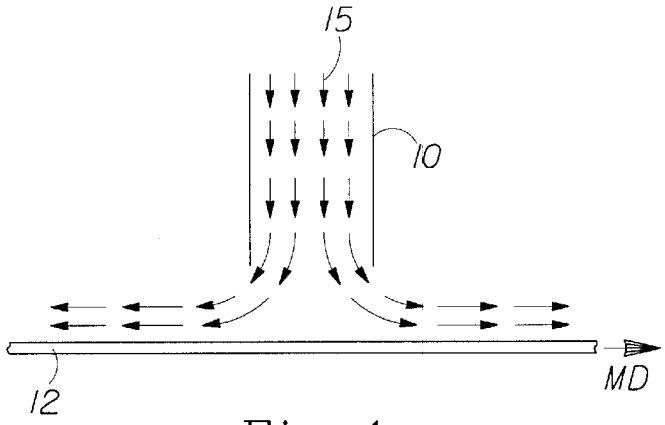
FIG. 1 is a simplified cross-sectional view of an impingement nozzle of the prior art showing air flowing through the nozzle onto a moving web.

FIG. 1 is a simplified cross-sectional view of an impingement nozzle of the prior art showing air flowing through the nozzle onto a moving web. The nozzle 10 directs heated air 15 to the surface of the moving web 12. The web 12 is moving in the machine direction, represented by the arrow labeled MD. As is depicted by the arrows representing the flow of air, with a typical slot-type nozzle 10, the air-stream 15 impinges on the web 12 an then splits such that about half of the air-stream 15 travels in the machine direction and about half travels counter to the machine direction. (In other than slot-type embodiments, the amount of air that is directed in each direction is based on the shape of the nozzle opening. In any case, the amount of air that travels in the machine direction is generally about equal to the amount of air that travels counter to the machine direction.) Such systems have been found to provide acceptable drying for certain relatively slow-moving webs, but are somewhat inefficient in transferring heat from the air 15 to the web 12 at high speeds (i.e. webs moving faster that about 3000 feet per minute (about 15.2 meters per second). This is believed to be due to the fact that the air traveling in the machine direction after impingement will have a low relative velocity versus the moving web 12, and consequently a relatively low heat transfer rate. Accordingly, in order to provide effective drying, such prior art impingement systems may require the air 15 be heated to temperatures that can damage the web 12, especially if the web 12 is moving at high speeds.

Figure 2:
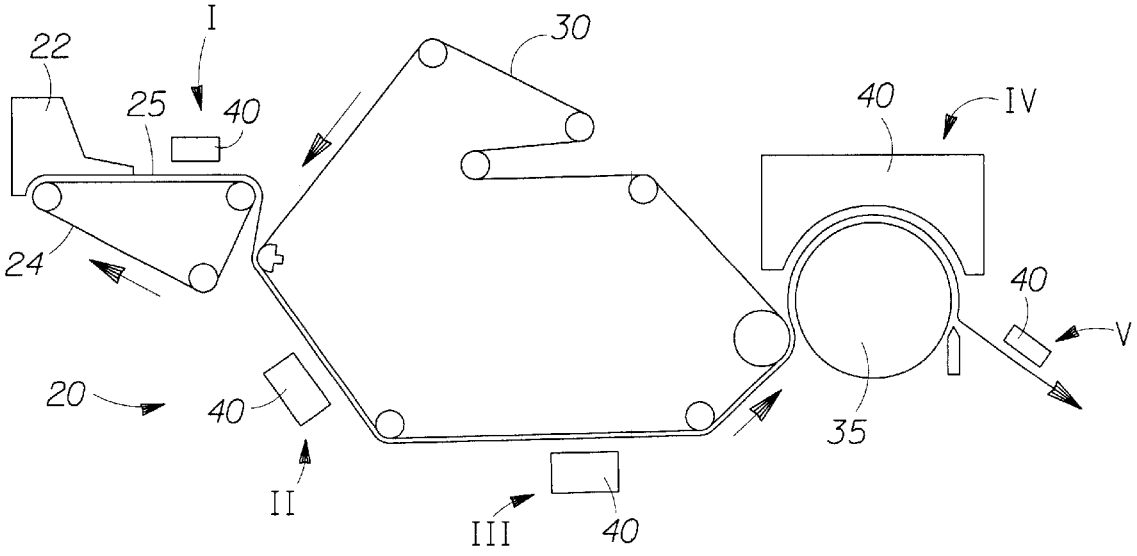
FIG. 2 is a simplified schematic representation of a continuous papermaking process, which is exemplary of a process with which the present invention may be used.

FIG. 2 is a simplified schematic representation of a continuous papermaking process wherein a paper web 25 is continuously formed from a mixture of raw materials to a web that can be converted into a final product. Exemplary processes and equipment for papermaking are described in more detail in U.S. Pat. No. 5,556,509, issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052, issued May 13, 1997 to Trokhan et al.; U.S. Pat. No. 5,637,194, issued Jun. 10, 1997 to Ampulski et al.; and U.S. Pat. No. 5,674,663, issued Oct. 7, 1997 to McFarland et al., the disclosures of which are incorporated herein by reference. Paper webs may also be made using through-air drying processes as described in commonly assigned U.S. Pat. No. 4,514,345, issued Apr. 30, 1985 to Johnson et al.; U.S. Pat. No. 4,528,239, issued Jul. 9, 1985; to Trokhan, U.S. Pat. No. 4,529,480, issued Jul. 16, 1985 to Trokhan; U.S. Pat. No. 4,637,859, issued Jan. 20, 1987 to Trokhan; and U.S. Pat. No. 5,334,289, issued Aug. 2, 1994 to Trokhan et al. The disclosures of the foregoing patents are incorporated herein by reference.

The first step of the papermaking process generally includes providing fibers, typically suspended in a liquid carrier. Equipment for preparing the aqueous dispersion of fibers is well known in the art. Some commonly known methods for the preparation of the aqueous dispersion of the papermaking fibers and exemplary characteristics of such an aqueous dispersion are described in greater detail in U.S. Pat. No. 4,529,480, which patent is incorporated by reference herein. The aqueous dispersion of fibers may be provided to a headbox 22 that distributes the aqueous dispersion on a wire screen 24. While a single headbox 22 is shown in FIG. 2, it is to be understood that there may be multiple headboxes in alternative arrangements of the process of the present invention. The headbox(es) 22 and the equipment for preparing the aqueous dispersion of fibers are typically of the type disclosed in U.S. Pat. No. 3,994,771, issued to Morgan and Rich on Nov. 30, 1976, which patent is incorporated by reference herein.

The present invention also contemplates the use of the web 25 formed by dry-air-laid processes. Such processes are described, for example, in S. Adanur, Paper Machine Clothing, Technomic Publishing Co., Lancaster, Pa., 1997, p. 138. The present invention also contemplates the use of the web 25 that has been rewetted. Rewetting of a previously manufactured dry web may be used for creating three-dimensional web structures by, for example, embossing the rewetted web 25 and than drying the embossed web. Also is contemplated in the present invention the use of a papermaking process disclosed in U.S. Pat. No. 5,656,132, issued on Aug. 12, 1997 to Farrington et al. and assigned to Kimberly-Clark Worldwide, Inc. of Neenah, Wis.

In a typical wet-laid process, after the aqueous dispersion is directed onto the wire screen 24, web 25 formed from the fibers is transferred to a papermaking belt 30. (The papermaking belt 30 may be any suitable papermaking belt known in the art, including but not limited to those described in U.S. Pat. No. 5,334,289 issued to Trokhan et al. on Aug. 2, 1994; U.S. Pat. No. 5,431,786 issued to Rasch et al. on Jul. 11, 1995; U.S. Pat. No. 5,529,644 issued to Trokhan et al. on Jun. 25, 1996; and U.S. Pat. No. 5,624,790 issued to Trokhan et al. on Apr. 29, 1997; all of which are incorporated by reference herein.) The papermaking belt 30 moves the web 25 through a series of unit operations that may include pressing, water removal such as dewatering and/or drying and any other desired operations. As used herein, the term "drying" means removal of water (or moisture) from the fibrous web 25 by vaporization. Vaporization involves a phase-change of the water from a liquid phase to a vapor phase, or steam. The term "dewatering" means removal of water from the web 25 without producing the phase-change in the water being removed. As used herein, the terms "removal of water" or "water removal" (or permutations thereof) are generic and include both drying and dewatering, along or in combination. The impingement drying apparatus 40 and process of the present invention are most typically applicable to the drying technique of water-removal.

After the web 25 is passed through the desired unit operations while on the papermaking belt 30, it is typically transferred to a drying roll 35, such as a Yankee dryer, or another type of drying apparatus. During this portion of the papermaking process, the web 25 is often subjected to impingement drying to reduce the moisture of the web 25 to acceptable levels for further converting operations. Therefore, in a typical papermaking process, such as the one shown in FIG. 2, the impingement drying apparatus 40 is generally located adjacent a portion of the drying cylinder 35. However, the impingement drying apparatus 40 can be located at any suitable location in the papermaking process from the stage of forming an embryonic web to a stage of post-drying. For example, FIG. 2 shows several locations (labeled I–V) in a typical papermaking process where impingement drying may be desirable. As one of ordinary skill in the art will recognize, the different stages represented include forming (I), wet transfer (II), pre-drying (III), drying cylinder (IV) and post drying (V). It should be understood that such locations are not intended to be exclusive, but merely to illustrate some of the possible arrangements of the impingement drying apparatus 40 in conjunction with a particular stage of the papermaking process. It should also be understood that although FIG. 2 shows a through air drying process, the apparatus of the present invention is equally applicable to other papermaking processes and other non-papermaking processes in which impingement of fluid is useful.

Figure 3:
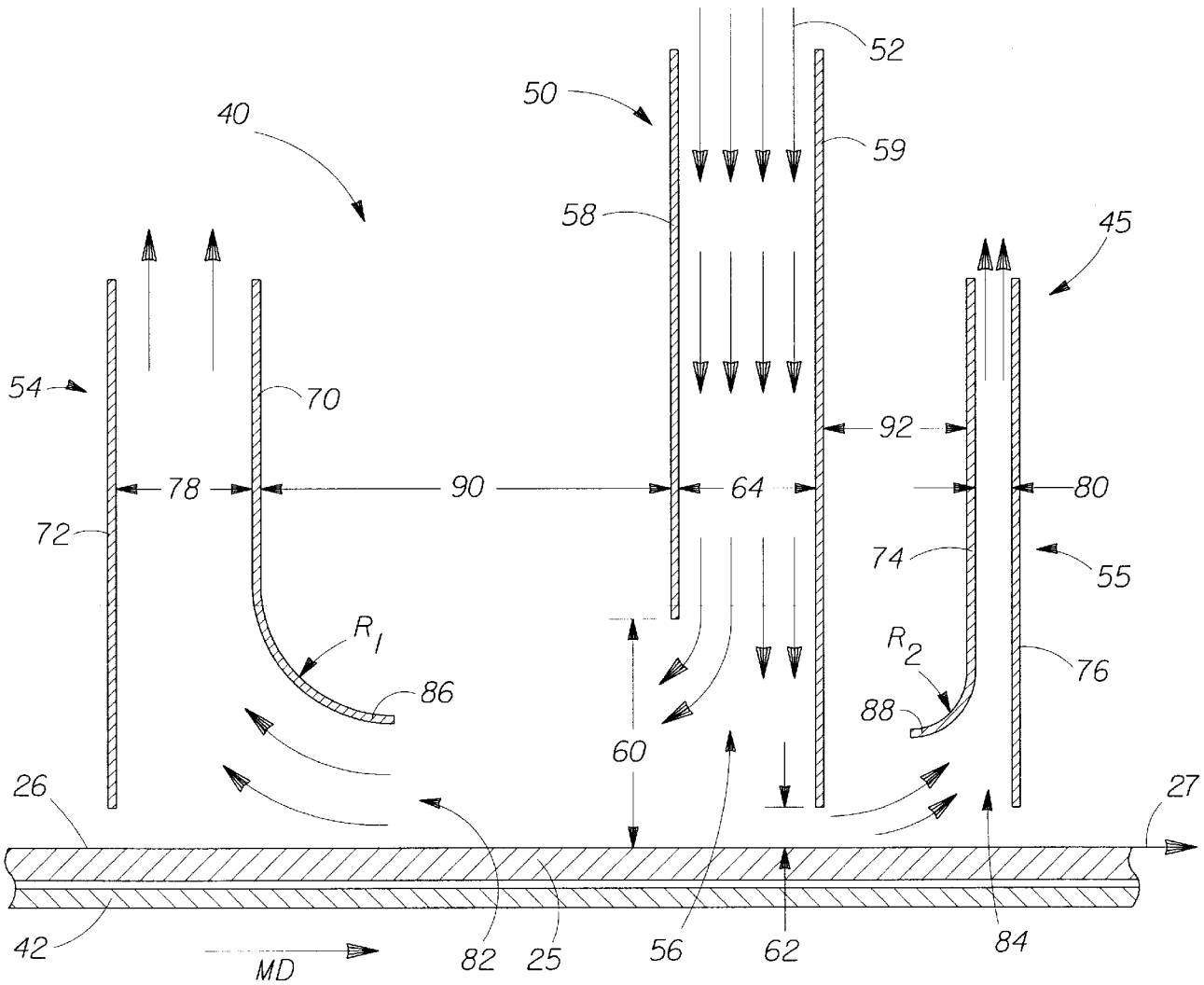
FIG. 3 is an enlarged, cross-sectional view of one embodiment of the apparatus of the present invention, including an impingement nozzle and a collection system.

FIG. 3 is an enlarged cross-sectional view of one embodiment of the apparatus of the present invention. The apparatus shown is in the configuration of an impingement drying apparatus 40 as would be useful for drying a paper web. The impingement drying apparatus 40 includes at least one nozzle 50 through which heated air or any other desired fluid is directed toward a surface 26 of an adjacent material, such as web 25. As shown, the material 25 may be directed past the impingement drying apparatus 40 by a support element 42, such as a belt, a drum, etc. In certain embodiments, the impingement drying apparatus 40 also includes at least one exhaust collection device, such as the upstream collection device 54 and/or the downstream collection device 55 shown in FIG. 3. The collection device(s) 54 and 55 are used to remove the air or other fluid that has been impinged onto the surface 26 along with any water vapor or other loose debris that may be disposed on or in the web 25. Any or all of the nozzle(s) 50 and/or the collection device(s) 54, 55 of the impingement drying apparatus 40 may be disposed within a hood 45 that structurally connects the parts to form a single operational unit.

The apparatus of the present invention may include any number of nozzles 50. In a preferred embodiment, the impingement drying apparatus 40 includes a single slot nozzle 50 that preferably extends across the entire width of the web 25 or at least across the entire width of the desired impingement area. The nozzle 50 preferably includes an opening 56 formed between an upstream wall 58 and a downstream wall 59. The upstream wall 58 of the nozzle 50 is located a predetermined distance from the support element 42. As shown in FIG. 3, the distance between the upstream wall 58 of the nozzle 50 and a plane 27 generally corresponding with the surface 26 of the web 25 oriented away from the support element 42, is herein referred to as the upstream impingement distance 60. The downstream wall 59 of the nozzle 50 is located a predetermined distance, downstream impingement distance 62, from the plane 27. (In circumstances wherein a web is not actually present, as may be the case when measuring the impingement distances of an apparatus not in use, the plane 27 should be located in a position that corresponds to the general location of the surface of the material to be impinged upon that is oriented toward the nozzle, as if the web were present.) In certain embodiments of the present invention, the upstream impingement distance 60 is greater than the downstream impingement distance 62. Preferably, the downstream impingement distance 62 is between about 1 percent and about 75 percent of the upstream impingement distance 60, between about 5 percent and about 50 percent of the upstream impingement distance 60 or between about 10 percent and about 25 percent of the upstream impingement distance 60.

If the apparatus of the present invention includes more than one nozzle 50, it is preferred that the nozzles 50 are separated from each other so as to not create interference with each other. In other words, it is preferred that the nozzles 50 of a multiple nozzle configuration be separated enough such that the velocity of the fluid from the upstream nozzle 50 exiting in the machine direction not significantly affect or be affected by the fluid exiting the downstream nozzle 50 in the counter-machine direction. If the separation between the nozzles is insufficient, the efficiency of heat transfer from the fluid to the adjacent material may be reduced due to regions of low relative velocity between the fluid stream and the material. Accordingly, it may be advantageous to include exhaust collection devices between any nozzles 50 disposed within a single hood 45 or configure the system to include multiple hoods 45, each including a single nozzle and exhaust collection devices, rather than multiple nozzles within a single hood assembly.

The difference between the upstream impingement distance 60 and the downstream impingement distance 62 formed by the unique configuration of the walls 58 and 59 of the nozzle 50 helps direct at least some of the air 52 or other fluid passed through the nozzle 50 to move in a direction that is counter to the machine direction MD after leaving the opening 56 of the nozzle 50. This configuration can significantly increase the heat transfer/drying performance of the apparatus in several different ways. First, such embodiments increase the amount of air 52 moving in the direction counter to the machine direction. This creates a high relative velocity between the fluid flow 52 and the moving web 25. The high relative velocity increases the friction between the web 25 and the air stream 52, which in turn, provides for more efficient heat transfer from the air 52 to the web 25. Second, the smaller downstream gap, impingement distance 62, creates a jet of air/fluid 52 in the machine direction. The increase in velocity of the air/fluid 52 directed in the machine direction again results in increased relative velocity between the web 25 and the air stream 52, which increases friction and heat transfer between the web 25 and the airflow 52. In a preferred embodiment, at least about 70 percent, at least about 80 percent or at least about 90 percent of the air 52 is directed by the nozzle 50 in a direction counter to the machine direction. (Accordingly, in certain embodiments, the flow rate of the fluid passing out of the nozzle in the machine direction is preferably lower than the flow rate of fluid passing out of the nozzle in the direction counter to the machine direction.)

Another parameter that may be used to impact the performance of the impingement drying apparatus 40 of the present invention is the relationship of the upstream impingement distance 60 and the distance between the upstream wall 58 of the nozzle 50 and the downstream wall 59 of the nozzle 50. (The distance between the upstream and downstream walls 58 and 59 of the nozzle 50 is shown in FIG. 3 as the distance 64. If the walls of the nozzle are not parallel to each other, the measurement of the distance 64 between the walls should be taken as the distance between projections of the walls 58 and 59 on the surface 26 made from a light source located directly above the nozzle 50 and centered between the walls 58 and 59.) In a preferred embodiment, the distance 64 between the walls 58 and 59 of the nozzle 50 should be between about 25 percent and about 200, between about 50 percent and about 150 or between about 80 percent and about 100 percent of the upstream impingement distance 60. In any case, it is generally understood that the distance between the walls of a nozzle and/or the impingement distances of the walls are factors in determining the size of the fluid stagnation region on the web (i.e. the region between the nozzle opening and the web where there is very low or zero relative fluid velocity between the fluid and the web). The stagnation region creates high pressure as compared to the surrounding regions due to a combination of the static and dynamic forces of the air being impinged on the surface of the web. The size of the stagnation region directly affects the strength of the high-pressure region that, in turn, forces the fluid to move away from the nozzle in the machine and counter-machine directions at greater velocities. Accordingly, a suitable relationship between the nozzle width (i.e. distance between the nozzle walls) and the impingement distances should be determined based on the particular use of the impingement apparatus 40. In one exemplary embodiment, the distance 64 between the walls 58 and 59 of the nozzle 50 is about 2 inches (about 5.08 cm), the upstream impingement distance 60 is about 2 inches (about 5.08 cm) and the downstream impingement distance is about 0.2 inches (about 0.5 cm).

The amount of fluid 52 passing through the nozzle 50 and its velocity can affect the overall performance of the impingement apparatus 40. Generally, the higher the average velocity of fluid 52 through the nozzle 50, the greater the relative velocity between the fluid 52 and the web 25. As noted above, this relative velocity creates friction, which provides for heat transfer between the web 25 and fluid 52. For certain paper drying embodiments, it has been found to be suitable for the average velocity of the fluid 52 moving through the nozzle 50 to be between about 50 percent and about 400 percent of the web speed. However, other higher and lower average velocities are contemplated for papermaking and other uses of the present invention.

The impingement drying apparatus 40 of the present invention may also include one or more exhaust collection devices, such as those shown in FIG. 3. In a preferred embodiment, the impingement drying apparatus 40. includes an upstream exhaust collection device 54 located upstream of the nozzle 50 and a downstream collection device 55 located downstream of the nozzle 50. The upstream collection device 54 includes an inner wall 70 located toward the upstream wall 58 of the nozzle 50 and an outer wall 72 disposed upstream from the inner wall 70. A distance, first width 78, separates the inner and outer walls 70 and 72 of the upstream collection device 54. An opening in the upstream exhaust collection device, inlet 82, is formed between the inner and outer walls 70 and 72 of the device 54 near the support element 42. Further, as shown in FIG. 3, the inlet portion 86 of the inner wall 70 of the exhaust collection device 54 disposed closest to the support element 42 may be curved or otherwise deflected out of the plane of the inner wall 70 to enhance the performance of the collection device 54. If the inlet portion 86 is curved, as shown in FIG. 3, the curve has a radius R1. The distance between the inner wall 70 of the upstream collection device 54 and the nozzle 50 is preferably between about 10 times and about 30 times the distance 64 between the nozzle walls.

The downstream collection device 55 includes an inner wall 74 located toward the downstream wall 59 of the nozzle 50 and an outer wall 76 disposed downstream from the inner wall 74. A distance, second width 80, separates the inner and outer walls 74 and 76 of the downstream collection device 55. An opening in the downstream exhaust collection device, inlet 84, is formed between the inner and outer walls 74 and 76 of the device 55 near the support element 42. Further, as shown in FIG. 3, the inlet portion 88 of the inner wall 74 of the exhaust collection device 55 disposed closest to the support element 42 may be curved or otherwise deflected out of the plane of the inner wall 74 to enhance the performance of the collection device 55. If the inlet portion 88 is curved, as shown in FIG. 3, the curve has a radius R2. The distance between the inner wall 74 of the downstream collection device 55 and the nozzle 50 is about 2 times and about 8 times the distance 64 between the nozzle walls.

In certain embodiments, it may be desirable for the first width 78 of the upstream collection device 54 to be greater than the second width 80 of the downstream collection device 55. This is generally due to the fact that in some embodiments of the present invention, more of the fluid flow is directed upstream, counter to the machine direction, than is directed in the machine direction. Removing the air 52 after it passes over a predetermined distance helps reduce the likelihood that the air will lessen the relative velocity between the airflow 52 and the web 52 or otherwise interfere with the efficiency of the apparatus. In such embodiments, the first width 78 may be about 3 times the second width 80 or greater, about 5 times the second width 80 or greater, or about 8 times the second width 80 or greater. It may also be desirable to locate the upstream collection device 54 at a distance from the nozzle 50 that is different than the distance from the downstream collection device 55 to the nozzle 50. (As is shown in FIG. 3, the distances 90 and 92 between the collection devices 54 and 55 and the nozzle 50 are preferably measured at a location where the inner wall of the collection device and the closest wall of the nozzle are generally parallel to each other.) Thus, within the hood 45, the impingement drying apparatus 40 may be asymmetric in that the nozzle 50 is not centered between the exhaust collection devices 45 and 55. For example, it may be desirable to locate the upstream exhaust collection device 54 a distance 90 from the nozzle 50 that is greater than the distance 92 between the downstream collection device 55 and the nozzle. This configuration can increase the efficiency of the apparatus by maintaining the region of highest relative velocity between the web and the fluid flow (generally upstream of the nozzle) over a greater distance than if the hood was symmetric and the same size. In certain embodiments of the present invention, it may be desirable for the distance 90 between the upstream collection device 54 and the nozzle 50 to be at least about 3 times as great, at least about 5 times as great or at least about 8 times as great as the distance 92 between the downstream collection device 54 and the nozzle 50.

The exhaust collection device(s) may include curved inlet portions as shown in FIG. 3. Such configurations help reduce flow separation and keep the flow of fluid adjacent the web until it is removed through the exhaust device. In certain embodiments, it may be desirable for the radius of the inlet portions to be within a particular range of values. For example, it has been found that, in one embodiment of a system used to dry a paper web, it is advantageous to have the radius R1 of the upstream inlet portion 86 be between about 50 percent and about 300 percent, between about 75 percent and about 250 percent or between about 100 percent and about 200 percent of the upstream impingement distance 60 (i.e. the distance between the upstream wall 58 of the nozzle and the support element 42). It has also been found to be advantageous to have the radius R2 of the downstream inlet portion 88 be between about 10 percent and about 200 percent, between about 15 percent and about 150 percent or between about 20 percent and about 100 percent of the upstream impingement distance 60.

Figure 4:
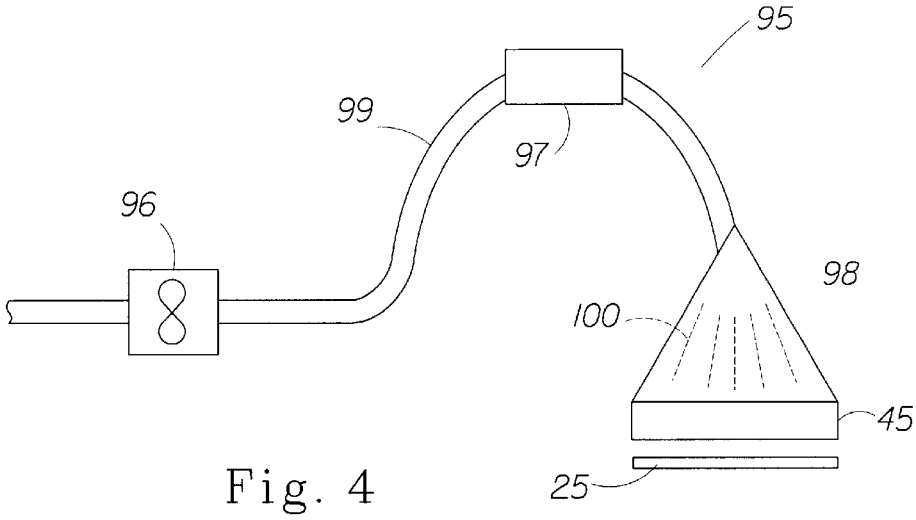
FIG. 4 is a simplified schematic view of a portion of one embodiment of a drying system of the present invention.

The impingement drying apparatus 40 of the present invention is preferably operatively associated with at least one fluid supply apparatus 95, as is shown in FIG. 4. The fluid supply apparatus may be directly or indirectly connected to any portion of the impingement drying apparatus 40. In the exemplary embodiment shown in FIG. 4, the fluid supply apparatus 95 comprises a compressor 96, a heater 97 and a diffuser 98 all connected by fluid supply lines 99. However, it should be understood that the fluid supply apparatus 95 can include any one or more of the above described devices or any other suitable device for supplying the fluid to the impingement drying apparatus 40 in a condition that is satisfactory for the intended use. Thus, the fluid supply apparatus 95 may include coolers, humidity adjusters, filters, mixers, electrostatic chargers, or any other device or unit operation that may affect the performance of the impingement device 40.

In certain embodiments including one or more diffusers, it may be desirable to provide baffles 100 within the diffuser to straighten or otherwise direct the fluid flow within the diffuser 98. The baffles 100 are generally used to distribute the fluid flowing into the nozzle 50 in the cross-machine direction, but can also be used to profile the flow in the machine direction, if desired. A uniform distribution of the fluid in the cross-direction can help ensure that the web is uniformly dried or otherwise treated in the cross-machine direction. Uniform distribution in the cross direction can also help increase the efficiency of the system by reducing the flow of the fluid in the cross-direction upon impingement. Any flow in the cross direction can reduce the relative velocities that can be obtained in the machine direction and the direction counter to the machine direction and thus, reduce the effectiveness of the impingement operation.

It may be advantageous to control the fluid flow volume/speed by choosing an appropriately shaped and sized fluid supply line 99. For example, it has been found that a suitable fluid supply line 99 is a circular cross-section pipe having a radius of between about 100 percent and about 800 percent of the distance 64 between the walls of the nozzle. However, other suitable sized and shaped fluid supply lines 99 can be used.

Figure 5:
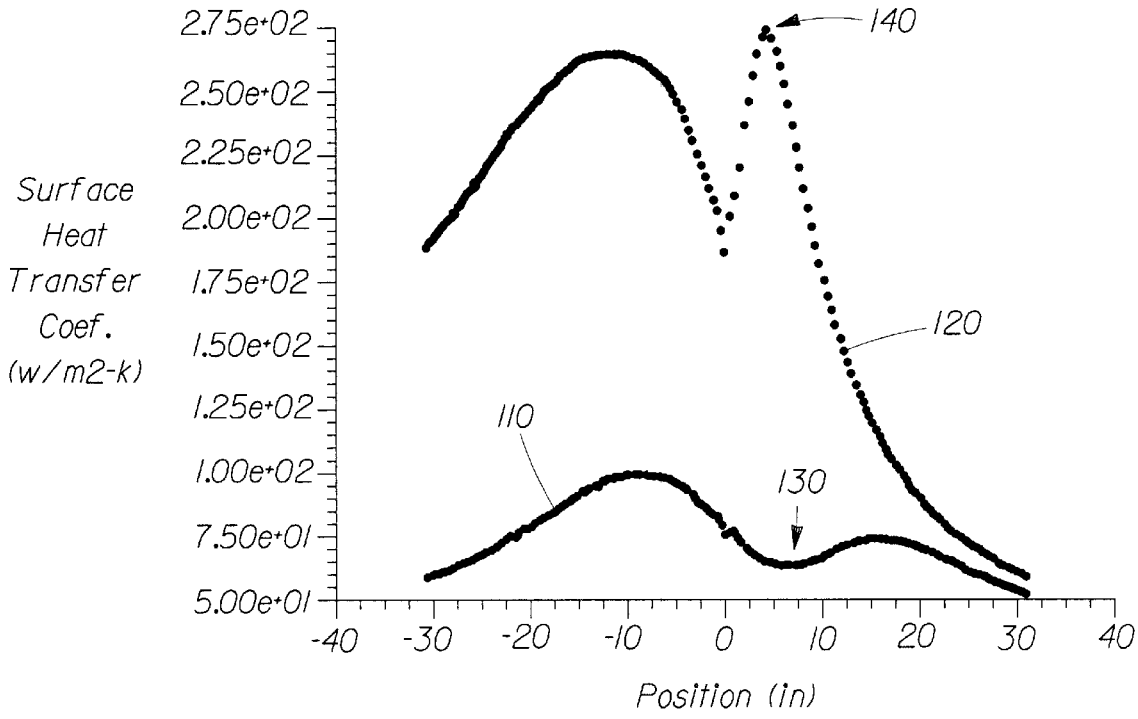
FIG. 5 is a graphical representation of the Surface Heat Transfer Coefficient of an exemplary prior art nozzle and one embodiment of the present invention plotted against the position of the impinged web.

FIG. 5 is a graphical representation of the surface heat transfer coefficient of a web moving at about 6000 feet per minute (about 30.48 m/s) past the nozzle of an impingement system (plotted on the Y-axis) versus the distance from the center of the impingement nozzle (plotted on the X-axis). The graph (produced by FLUENT software available from Fluent, Inc. of Lebanon, N.H.) has two plotted curves, curve 110 representing the plot of a typical impingement system and curve 120 representing the plot of one exemplary embodiment of the impingement system of the present invention. For both curves, all of the parameters that affect the surface heat transfer coefficient are the same, except the design of the nozzle. Specifically, in each case, the web speed is 6000 feet/minute (about 30.48 meters/second), the web temperature is about 250 Degrees Fahrenheit (about 121 Degrees Celsius) and the web thickness is about 0.2 in (about 0.508 cm). The fluid impinged on the web is air at a temperature of about 1000 Degrees Fahrenheit (about 537 Degrees Celsius) and moving at an average velocity of about 9842 feet/minute (about 50 meters/second) through the nozzle. Both nozzles have a width (distance between the walls) of 2 inches (about 5.08 cm) and the upstream impingement distance 60 of each nozzle is about 2 inches (about 5.08 cm). The downstream impingement distance 62 of the conventional nozzle is the same as the upstream impingement distance 60, about 2 inches (about 5.08 cm), whereas the downstream impingement distance 62 of the nozzle of the present invention is about 0.2 inches (about 0.508 cm).

As can be seen in FIG. 5, the nozzle design of the present invention unexpectedly increases the performance of the impingement drying apparatus 40 in several ways. First, the entire curve 120 produced by the nozzle of the present invention is shifted upward along the Y-axis from the curve 110 of a standard nozzle. This shift upward along the Y-axis demonstrates an increase in the surface heat transfer coefficient between the fluid stream and the web. Thus, in the context of papermaking, the nozzle 50 of the present invention can provide for more efficient drying of the web while keeping all other parameters the same as current systems. Second, as can be seen in FIG. 5, conventional impingement drying nozzle configurations have an area of reduced surface heat transfer located just downstream of the nozzle opening (shown in FIG. 5 as local minimum 130). This is due to the reduced relative velocity between the web and the airflow in that region. Surprisingly, the nozzle configuration of the present invention increases the heat transfer coefficient in the same region. In fact, in the example shown in FIG. 5, the nozzle 50 of the present invention creates a local maximum 140 in the heat transfer coefficient curve 140 in the region where the conventional nozzle has its local minina 130. Thus, the nozzle 50 of the present invention not only is more efficient in transferring heat upstream of the nozzle, but also provides for more efficient transfer of heat downstream of the nozzle, as compared to conventional nozzles. The nozzle 50 of the present invention also provides for an increase in the distance and length of time over which the web can be effectively dried or otherwise treated by the impingement system, which further increases the system's efficiency and effectiveness.

Figure 6:
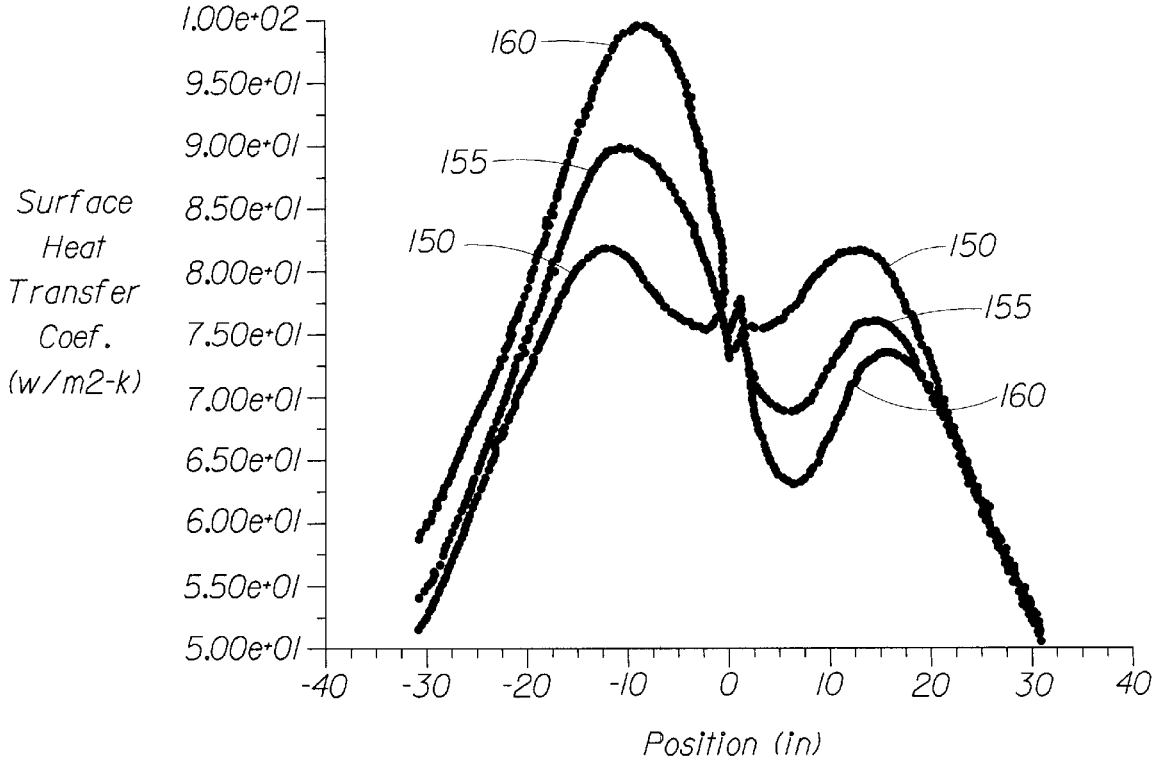
FIG. 6 is a graphical representation of the Surface Heat Transfer Coefficient of an exemplary prior art nozzle and plotted against the position of the impinged web for three different web speeds.

Yet another benefit of the configuration of the present invention is that the impingement apparatus gets more efficient as the web speed increases. This increase in efficiency with increased web speed is true for locations both upstream and downstream of the nozzle. In contrast, as shown in FIG. 6, with conventional nozzle configurations, the surface heat transfer coefficient increases with increases in web speed for locations upstream of the nozzle, but decreases with increased web speed for locations downstream of the nozzle. This decrease is believed to be due to the decreased relative velocity between the web and the fluid flow downstream of the nozzle. FIG. 6 is a graphical representation of the surface heat transfer coefficient between a web and fluid impinged onto the web through a conventional nozzle. Curve 150 is representative of a web that is not moving, and thus has a velocity of zero. Curve 155 is representative of a web moving at about 3000 feet per minute (about 15.24 m/s). Curve 160 is representative of a web moving at about 6000 feet per minute (about 30.48 m/s). The exemplary curves of FIG. 6 (produced by the FLUENT software used to produce the curves of FIG. 5) are based on the same parameters as were used for the curve 110 of the conventional nozzle in FIG. 5, except that the speed of the web is variable, as described above and the scale of the Y-axis is modified to better show the differences between the curves.

While particular embodiments and/or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention. Therefore, the appended claims are intended to cover all such changes and modifications that are within the scope of this invention.

What is claimed is:

1. A heat transfer apparatus comprising:

a) a support element designed to receive a material thereon, the material having a surface oriented away from the support element and moving in a machine direction;

b) at least one fluid supply designed to produce and discharge a fluid;

c) at least one nozzle having an open area formed by an upstream wall and a downstream wall relative to the machine direction, the upstream wall and the downstream wall separated by an opening distance, the nozzle connected to the fluid supply and disposed generally adjacent to the support element and spaced apart therefrom so as to form an impingement distance between each wall of the nozzle and a plane generally corresponding to the surface of the material, wherein the impingement distance between the upstream wall and the plane is greater than the impingement distance between the downstream wall and the plane such that at least a portion of the fluid is delivered through the nozzle to a predetermined portion of the material in a direction that is counter to the machine direction; and wherein the fluid passing through the opening in the nozzle has a first flow rate passing out of the nozzle in the machine direction and a second flow rate passing from the nozzle in the direction counter to the machine direction, the second flow rate being greater than the first flow rate.

2. The apparatus of claim 1 wherein the impingement distance between the downstream wall of the nozzle and the plane ranges between about 10% and about 25% of the impingement distance between the upstream wall and the plane.

3. The apparatus of claim 2 wherein the opening distance between the upstream wall and the downstream wall of the nozzle ranges from about 80% to about 100% of the impingement distance between the upstream wall and the plane.

4. A heat transfer apparatus comprising:

a) a support element designed to receive a material thereon, the material having a surface oriented away from the support element and moving in a machine direction;

b) at least one fluid supply designed to produce and discharge a fluid;

c) at least one nozzle having an open area formed by an upstream wall and a downstream wall relative to the machine direction, the upstream wall and the downstream wall separated by an opening distance, the nozzle connected to the fluid supply and disposed generally adjacent to the support element and spaced apart therefrom so as to form an impingement distance between each wall of the nozzle and a plane generally corresponding to the surface of the material, wherein the impingement distance between the upstream wall and the plane is greater than the impingement distance between the downstream wall and the plane such that at least a portion of the fluid is delivered through the nozzle to a predetermined portion of the material in a direction that is counter to the machine direction;

d) an upstream collection device which is disposed upstream relative to the nozzle; and e) a downstream collection device that is disposed downstream relative to the nozzle, wherein the upstream collection device has a first width and the downstream collection device has a second width, the second width being less than the first width.

5. The apparatus of claim 4 wherein the distance between the upstream collection device and the nozzle is greater than the distance between the downstream collection device and the nozzle.

6. The apparatus of claim 4 wherein the collection device includes an exhaust duct.

7. A heat transfer apparatus comprising:

a) a support element designed to receive a material thereon, the material having a surface oriented away from the support element and moving in a machine direction;

b) at least one fluid supply designed to produce and discharge a fluid;

c) at least one nozzle having an open area formed by an upstream wall and a downstream wall relative to the machine direction, the upstream wall and the downstream wall separated by an opening distance, the nozzle connected to the fluid supply and disposed generally adjacent to the support element and spaced apart therefrom so as to form an impingement distance between each wall of the nozzle and a plane generally corresponding to the surface of the material, wherein the impingement distance between the upstream wall and the plane is greater than the impingement distance between the downstream wall and the plane such that at least a portion of the fluid is delivered through the nozzle to a predetermined portion of the material in a direction that is counter to the machine direction;

d) an upstream collection device which is disposed upstream relative to the nozzle; and e) a downstream collection device that is disposed downstream relative to the nozzle, wherein the upstream collection device has a radius ranging from 100% to 200% of the impingement distance between the upstream wall and the plane.

8. A heat transfer apparatus comprising:

a) a support element designed to receive a material thereon, the material having a surface oriented away from the support element and moving in a machine direction;

b) at least one fluid supply designed to produce and discharge a fluid;

c) at least one nozzle having an open area formed by an upstream wall and a downstream wall relative to the machine direction, the upstream wall and the downstream wall separated by an opening distance, the nozzle connected to the fluid supply and disposed generally adjacent to the support element and spaced apart therefrom so as to form an impingement distance between each wall of the nozzle and a plane generally corresponding to the surface of the material, wherein the impingement distance between the upstream wall and the plane is greater than the impingement distance between the downstream wall and the plane such that at least a portion of the fluid is delivered through the nozzle to a predetermined portion of the material in a direction that is counter to the machine direction;

d) an upstream collection device which is disposed upstream relative to the nozzle; and e) a downstream collection device that is disposed downstream relative to the nozzle, wherein the downstream collection device has a radius ranging from 20% to 100% of the impingement distance between the upstream wall and the plane.

9. A heat transfer apparatus comprising:

a) a support element designed to receive a material thereon, the material having a surface oriented away from the support element and moving in a machine direction;

b) at least one fluid supply designed to produce and discharge a fluid;

c) at least one nozzle having an open area formed by an upstream wall and a downstream wall relative to the machine direction, the upstream wall and the downstream wall separated by an opening distance, the nozzle connected to the fluid supply and disposed generally adjacent to the support element and spaced apart therefrom so as to form an impingement distance between each wall of the nozzle and a plane generally corresponding to the surface of the material, wherein the impingement distance between the upstream wall and the plane is greater than the impingement distance between the downstream wall and the plane such that at least a portion of the fluid is delivered through the nozzle to a predetermined portion of the material in a direction that is counter to the machine direction;

wherein the fluid supply includes a diffuser having baffles to distribute the fluid in a cross-machine direction.

10. A heat transfer apparatus comprising:

a) a support element designed to receive a material thereon, the material having a surface oriented away from the support element and moving in a machine direction;

b) at least one fluid supply designed to produce and discharge a fluid;

c) at least one nozzle having an open area formed by an upstream wall and a downstream wall relative to the machine direction, the upstream wall and the downstream wall separated by an opening distance, the nozzle connected to the fluid supply and disposed generally adjacent to the support element and spaced apart therefrom so as to form an impingement distance between each wall of the nozzle and a plane generally corresponding to the surface of the material, wherein the impingement distance between the upstream wall and the plane is greater than the impingement distance between the downstream wall and the plane such that at least a portion of the fluid is delivered through the nozzle to a predetermined portion of the material in a direction that is counter to the machine direction;

wherein at least about 70 percent of the fluid is delivered out of the nozzle in a direction that is counter to the machine direction.

11. A process for efficiently transferring heat between a fluid and a moving material, the method comprising the steps of:

a) providing at least one nozzle having an opening formed by an upstream wall and a downstream wall relative to the machine direction, the nozzle connected to a fluid supply and disposed generally adjacent to the support element and spaced apart therefrom so as to form an impingement distance between each wall of the nozzle and a plane generally corresponding to a surface of a material onto which the fluid is to be impinged, wherein the impingement distance between the upstream wall and the plane is greater than the impingement distance between the downstream wall and the plane;

b) providing a material adjacent the opening in the nozzle, the material moving in the machine direction; and c) supplying a fluid from the fluid supply through the nozzle onto the material such that at least about 70 percent of the fluid is delivered out of the nozzle in a direction that is counter to the machine direction.

12. The process of claim 11 further including the step of collecting the fluid after it has been impinged onto the material.

13. The process of claim 11 wherein the continuous sheet of material comprises a fibrous web or a film.

14. The process of claim 11 wherein the material is moving in the machine direction at a rate of at least about 3,000 feet per minute (about 15.2 meters per second).

15. The process of claim 11 wherein the fluid is a heated or cooled gas.

16. A process for efficiently transferring heat between a fluid and a moving material, the method comprising the steps of:

a) providing at least one nozzle having an opening formed by an upstream wall and a downstream wall relative to the machine direction, the nozzle connected to a fluid supply and disposed generally adjacent to the support element and spaced apart therefrom so as to form an impingement distance between each wall of the nozzle and a plane generally corresponding to a surface of a material onto which the fluid is to be impinged, wherein the impingement distance between the upstream wall and the plane is greater than the impingement distance between the downstream wall and the plane;

b) providing a material adjacent the opening in the nozzle, the material moving in the machine direction; and c) supplying a fluid from the fluid supply through the nozzle onto the material such that at least a portion of the fluid is delivered out of the nozzle in a direction that is counter to the machine direction, wherein the fluid is transferred through the opening in the nozzle at a velocity that is generally uniform in a cross direction that is perpendicular to the machine direction.

17. A process for efficiently transferring heat between a fluid and a moving material, the method comprising the steps of:

a) providing at least one nozzle having an opening formed by an upstream wall and a downstream wall relative to the machine direction, the nozzle connected to a fluid supply and disposed generally adjacent to the support element and spaced apart therefrom so as to form an impingement distance between each wall of the nozzle and a plane generally corresponding to a surface of a material onto which the fluid is to be impinged, wherein the impingement distance between the upstream wall and the plane is greater than the impingement distance between the downstream wall and the plane;

b) providing a material adjacent the opening in the nozzle, the material moving in the machine direction; and c) supplying a fluid from the fluid supply through the nozzle onto the material such that at least a portion of the fluid is delivered out of the nozzle in a direction that is counter to the machine direction, wherein the fluid passing through the opening in the nozzle has a first flow rate passing out of the nozzle in the machine direction and a second flow rate passing from the nozzle in the direction counter to the machine direction, the second flow rate being greater than the first flow rate.

18. A hood assembly for a fluid impingement system, comprising:

at least one nozzle, the nozzle having a fluid supply end and a fluid discharge end, the fluid discharge end having an opening formed between a first nozzle wall and a second nozzle wall, the first nozzle wall extending further away from the fluid supply end than the second nozzle wall, a first collection conduit disposed generally adjacent the first wall of the nozzle, the first collection conduit having a first exhaust opening; and a second collection conduit disposed generally adjacent the second wall of the nozzle, the second collection conduit having a second exhaust opening, wherein the second exhaust opening is larger than the first exhaust opening.

19. The hood assembly of claim 18 wherein the first collection conduit is disposed a first distance from the first wall of the nozzle and the second collection conduit is disposed a second distance from the second wall of the nozzle, and wherein the second distance is greater than the first distance.

20. The hood assembly of claim 18 wherein the first collection conduit has an inner wall disposed toward the nozzle, the inner wall being curved toward the first wall of the nozzle in a defined first radius, and the second collection conduit has an inner wall disposed toward the nozzle, the inner wall being curved toward the second wall of the nozzle in a defined second radius, and wherein the first radius is smaller than the second radius.

* * * * *